US009938978B2

(12) United States Patent
Abu Al-Rubb

(10) Patent No.: US 9,938,978 B2
(45) Date of Patent: Apr. 10, 2018

(54) WASTE PUMP

(71) Applicant: Khalil Abu Al-Rubb, Doha (QA)

(72) Inventor: Khalil Abu Al-Rubb, Doha (QA)

( * ) Notice: Subject to any disclaimer, the term of this patent is extended or adjusted under 35 U.S.C. 154(b) by 682 days.

(21) Appl. No.: 14/372,191

(22) PCT Filed: Jan. 17, 2013

(86) PCT No.: PCT/GB2013/050097

§ 371 (c)(1),
(2) Date: Jul. 14, 2014

(87) PCT Pub. No.: WO2013/108028

PCT Pub. Date: Jul. 25, 2013

(65) Prior Publication Data

US 2015/0030429 A1 Jan. 29, 2015

(30) Foreign Application Priority Data

Jan. 19, 2012 (GB) ..... 1200970.0

(51) Int. Cl.

| | |
|---|---|
| ***F04D 7/04*** | (2006.01) |
| ***E03F 5/22*** | (2006.01) |
| ***E03C 1/122*** | (2006.01) |
| ***F04D 27/02*** | (2006.01) |
| ***F04D 29/66*** | (2006.01) |

(52) U.S. Cl.

CPC ..... *F04D 7/045* (2013.01); *E03C 1/1227* (2013.01); *E03F 5/22* (2013.01); *F04D 27/02* (2013.01); *F04D 29/669* (2013.01)

(58) Field of Classification Search

CPC . F04D 7/00; F04D 7/045; F04D 27/02; F04D 29/669; E03C 1/1227; E03F 5/22

USPC ..... 417/118, 120

See application file for complete search history.

(56) References Cited

U.S. PATENT DOCUMENTS

| | | | | |
|---|---|---|---|---|
| 4,948,010 | A * | 8/1990 | Wiggins | B67D 7/04 137/398 |
| 5,074,758 | A | 12/1991 | McIntyre | |
| 6,213,139 | B1 * | 4/2001 | Rogers | B09B 1/00 137/1 |
| 7,611,333 | B1 * | 11/2009 | Harrington | F02K 9/46 417/120 |

(Continued)

FOREIGN PATENT DOCUMENTS

| | | |
|---|---|---|
| CN | 201501947 U | 6/2010 |
| CN | 201598682 U | 10/2010 |
| CN | 201801947 U | 4/2011 |

(Continued)

OTHER PUBLICATIONS

Korean Intellectual Property Office, Official Notice of Preliminary Rejection, dated Jul. 28, 2016, 3 pages.

(Continued)

*Primary Examiner* — Richard Edgar
*Assistant Examiner* — Michael Sehn
(74) *Attorney, Agent, or Firm* — Maschoff Brennan

(57) ABSTRACT

The invention is a device which uses stored pressure to pump waste and a corresponding method of use. Waste is stored in a first chamber and the chamber is subsequently sealed by a valve and pressurized prior to a second valve opening. The pressurized waste is thereby ejected from the pressure chamber down an outlet pipe.

19 Claims, 9 Drawing Sheets

(56) References Cited

U.S. PATENT DOCUMENTS

| | | | | |
|---|---|---|---|---|
| 2008/0095630 | A1* | 4/2008 | Keener | F04D 7/045 416/182 |
| 2009/0000019 | A1* | 1/2009 | Tolles | E03F 1/006 4/431 |

FOREIGN PATENT DOCUMENTS

| | | | | |
|---|---|---|---|---|
| DE | 37 19 068 | A1 | 12/1988 | |
| DE | 9013250 | U1 | 11/1990 | |
| DE | 4211806 | A1 | 10/1993 | |
| EP | 1517047 | A1 * | 3/2005 | F04F 1/06 |
| JP | S48-60078 | A | 8/1973 | |
| JP | S51-15222 | A | 2/1976 | |
| JP | S51-030605 | A | 3/1976 | |
| JP | S52-119505 | A | 10/1977 | |
| JP | S60-8499 | U | 1/1985 | |
| JP | H04-175496 | A | 6/1992 | |
| JP | H05-89296 | U | 12/1993 | |
| JP | 2000-288591 | A | 10/2000 | |
| JP | 2003-96855 | A | 4/2003 | |
| NL | 1032058 | C1 | 6/2006 | |
| WO | 02/20909 | A1 | 3/2002 | |
| WO | 0220909 | A1 | 3/2002 | |

OTHER PUBLICATIONS

First Office Action regarding Chinese application 2013800112763.
European Search Report dated May 22, 2012 as received in European Application No. 1200970.0, 3 pgs.
JP Office Action dated Nov. 22, 2016 as received in Application No. 2014-552688 (English Translation).
KR Notice of Reasons for Rejection dated May 30, 2017 as received in Application No. 2014-552688 [Machine Translation].
EP Office Action dated Jun. 13, 2017 as received in Application No. 13702257.

* cited by examiner

WASTE PUMP

FIELD OF THE INVENTION

This invention relates to a pumping device for pumping waste and a method of pumping waste. More specifically, this invention relates to a device which uses stored pressure to pump waste and a corresponding method of use.

BACKGROUND

The waste may be food waste; fresh, potable water (white water); water from domestic equipment other than toilets, e.g. bathtubs, showers, sinks, washing machines, etc. (grey-water); or sewage and/or sewage water (blackwaste).

If a sanitary item, such as a sink, shower, toilet, etc. is installed close to or below the level of a drain pipe, the gravitational force acting on the waste to force it along the drain pipe may be low or even negative, i.e. insufficient to cause the waste to flow along the drain pipe. To overcome this problem, waste may pumped along the drain pipe by a pump activated when there is waste to be moved.

A macerating toilet uses a grinding or blending mechanism to reduce human waste to a slurry, which can then be moved by a pump. An electric pump is most often used to pump the macerated slurry into a sewage system.

Macerating units not for use in macerating toilets may be provided by ultrasonic devices. Ultrasound disintegration of sewage sludge is a macerating water treatment technology. The ultrasonic energy subjected to the sewage mechanically destroys both bacterial cells and difficult-to-degrade organics.

The disadvantage of the above described pumping mechanism is that the pump is noisy due to the powerful pumping required to pump the slurry. The pump is required to be operated during the period that waste is being moved along the sewer drain pipe.

SUMMARY

The above described macerating and/or pumping devices are for use in boats, mobile homes, flats, houses, and other temporary or permanent structures. In a residential application, for example, the noisy and intrusive pumping is clearly an unwanted feature of a waste pumps.

According to a first aspect of the invention, there is provided a pumping device for pumping waste, comprising a waste chamber, for storing waste, having an inlet for receiving waste and an outlet for transmitting waste; a pump connected to the waste chamber; a first valve for controlling received waste from the waste chamber inlet; and a second valve for controlling transmitted waste through the waste chamber outlet; wherein the pump is operable to increase pressure within the waste chamber when the first and second valves are closed; and the waste is forced from the waste chamber through the second valve by the pressure within the waste chamber when the second valve open is opened. The pumping force is provided by the pressure contained within the waste chamber. The noise of the pumping is less than that for conventional pumps and the frequency that pumping is required is reduced as an amount of waste may be stored within the waste chamber. A further advantage of the device is that a plurality of valves separates an upstream waste source from a downstream sewerage system or similar. This valve system acts as a barrier to insects and the similar, such as cockroaches, from passing through the device to reach the upstream waste source and subsequently entering an abode via the connecting sewerage system. The device may ensure that at least one valve of the device is closed to block the upstream pipe from the downstream pipe. Another advantage of the invention is that waste pumped by the device is disintegrated by the pumping action. The greater the pumping pressure, the greater the disintegrative effect will be.

Preferably, the pumping device further comprises a pressure chamber to store pressure generated by the pump, wherein the pressure chamber selectively releases stored pressure into the waste chamber. This separate chambers may accumulate pressure at any time and is therefore not limited to accumulating pressure when the waste chamber is closed. Further, the separate pressure chamber allows for a slower pumping to increase pressure in a chamber further reducing the noise generated by the system as a less powerful pump is required.

Preferably, the pumping device further comprises a macerator in the waste chamber. The macerator may be a rotating blade arrangement, ultrasonic arrangement or similar. The slurry produced by the macerator is more easily pumped along a pipe, such as a sewage pipe. An ultrasound sonotrode may be installed with or instead of a mechanical macerator in the waste chamber to breakdown any solid waste into a slurry that can be easily pumped along an associated waste pipe.

Preferably, the pumping device further comprises a bypass conduit to enable a flow of waste around the waste chamber when the first and second valves are closed. Preferably, the bypass conduit has an entry valve for controlling the flow of waste into the bypass conduit, and an exit valve for controlling the flow of waste out of the bypass conduit. The bypass conduit allows for the selective use of the pumping device. If the pumping device has malfunctioned, the bypass provides an alternative route to feed waste through. Also, the bypass allows the pumping device to be used in series with one or more other pumping devices.

Preferably, the pumping device further comprises a waste level sensor in the waste chamber, wherein the waste is forced from the waste chamber when the waste level in the waste chamber exceeds a predetermined value. This allows for the most efficient use of power for pumping waste by only pumping when the waste chamber is full. Alternatively, the level sensor may allow for the pumping of waste whereby the amount space in the waste container not occupied by waste is varied to get a different pumping characteristic, i.e. the more free space there is in the waste container, more fluid may be pumped into the waste container thereby increasing the pumping power of the pumping device.

Preferably, liquid waste is stored in the waste chamber until the chamber reaches a predetermined level or when solid waste enters the chamber (an additional detector may used). A macerating device, such as the mechanical macerator or an ultrasonic device are then activated to produce a slurry suitable for pumping. The release of odours from the stored waste is thereby minimised. The solid waste detection may be made by a fluid level sensor and/or a weight sensors in the waste chamber.

Preferably, the pumping device further comprises a clock, wherein the operation of the waste chamber is dependent upon the time of day as provided by the clock. The pumping frequency may be manipulated to reduce or increase pumping at an period of time during a day and/or week. For example, pumping may be triggered early in the evening to lessen the likelihood of pumping being required later in the evening.

Preferably, the pumping device further comprises a vacuum chamber coupled to the waste chamber output, the vacuum chamber having an inlet and an outlet. Preferably, the pump is operable to reduce the pressure in the vacuum chamber. The vacuum chamber increases the pressure differential in front and behind of the waste, thus the waste can be more accelerated increasing the pumping effect. Preferably, the pumping device further comprises a valve at the vacuum chamber output, wherein the device is operable to open the pressure chamber output and the vacuum chamber output when the pressure in the pressure chamber is greater than the pressure in the vacuum chamber. The valves provide a simple mechanism for controlling the flow of waste. The pressure in the vacuum chamber may be reduced to an extend greater than that by which the pressure chamber is increased. The waste chamber input valve may be opened with the waste chamber output, thereby exposing the waste chamber input to the reduced pressure of the vacuum chamber. Waste may therefore be sucked from the waste chamber inlet. The device can eliminate or minimize the amount of water required to flush a toilet connected upstream to the device compared to a conventional flushing toilet.

Preferably, the pressure chamber output is opened prior to the opening of the vacuum chamber output. This timing feature accelerates the waste towards the output of the device prior to the output being opened. This reduces the flow of waste from outside the vacuum chamber through the vacuum chamber output caused by a relative vacuum in the vacuum chamber compared that at the output of the device.

Preferably, the pump and the macerator are powered by a single motor. A single motor provides a more reliable, cheaper, and more compact pumping device.

Preferably, the pump and the macerator intercommunicate. The pump and macerator may be joined so that they rotate as one. This design reduces the complexity of the pumping and macerator system.

According to a second aspect of the invention, there is provided a method of pumping waste comprising the steps: opening a first valve to enable waste to flow into a waste chamber and closing a second valve to stop waste flowing out of the waste container; closing the first valve to stop waste flowing into the waste chamber; increasing the pressure within the waste chamber to be greater than the pressure outside the waste chamber using a pump; and opening the second valve to enable waste to flow out of the waste chamber. The pumping force is provided by the pressure contained within the waste chamber. The noise of the pumping is less than that for conventional pumps and the frequency that pumping is required is reduced as an amount of waste may be stored within the waste chamber.

Preferably, the pump first increases the pressure within a pressure chamber before opening the pressure chamber to the waste chamber. The separate chambers may accumulate pressure at any time and is therefore not limited to accumulating pressure when the waste chamber is closed. Further, a separate pressure chamber allows for a slower pumping to increase pressure in a chamber further reducing the noise generated by the system as a less powerful pump is required.

Preferably, the method further comprises the step of using a macerator to macerate the waste within the waste chamber. The macerator may be a rotating blade arrangement, ultrasonic arrangement or similar. The slurry produced by the macerator is more easily pumped along a pipe, such as a sewage pipe.

Preferably, the method further comprises the steps of decreasing the pressure within a vacuum chamber coupled to, but closed from, the waste chamber; and opening the waste chamber to the vacuum chamber. Preferably, the pump pumps a fluid from the vacuum chamber into the waste chamber to alter the pressure of the vacuum and waste chambers. The vacuum chamber increases the pressure differential in front and behind of the waste, thus the waste can be more accelerated increasing the pumping effect.

Preferably, the first valve is not closed until the amount of waste in the waste chamber as detected by a waste level sensor is above a predetermined threshold. Preferably, the first valve is selectively operable to be dependent upon the time of day as provided by a clock. The pumping frequency may be manipulated to reduce or increase pumping during a period of time during a day and/or week. For example, pumping may be triggered early in the evening to lessen the likelihood of pumping being required later in the evening.

BRIEF DESCRIPTION OF THE DRAWINGS

The invention will now be described by way of example only, with reference to the accompanying drawings, in which.

DETAILED DESCRIPTION

Figure 1:
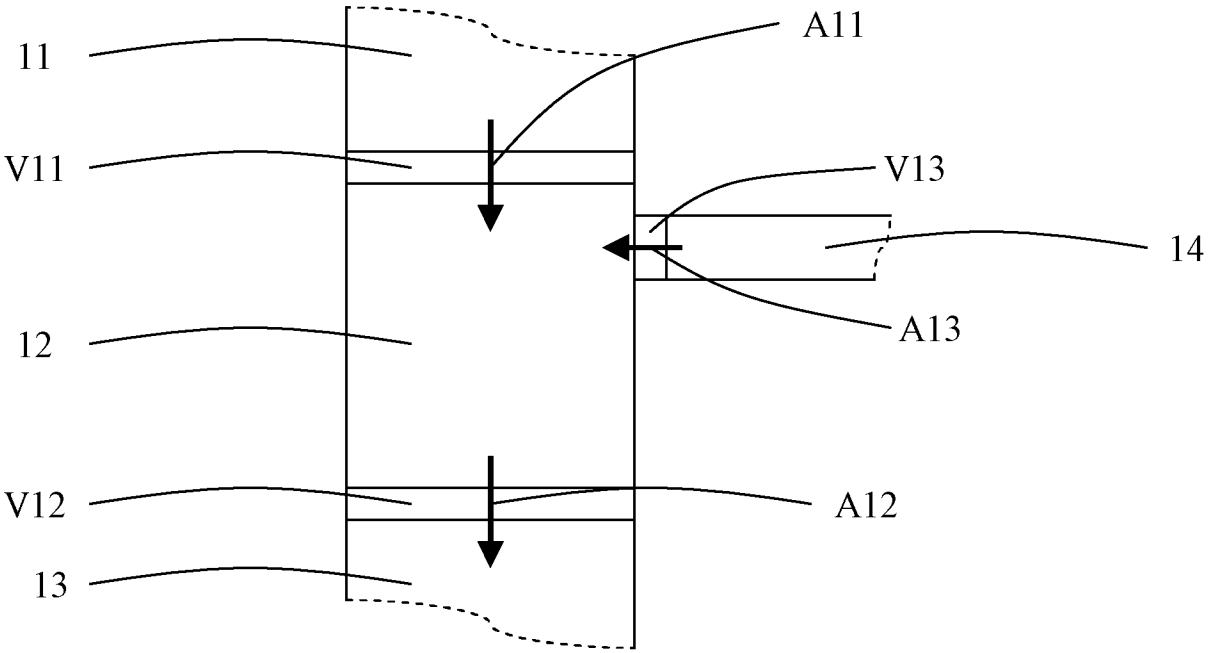
FIG. 1 is a schematic view of a first embodiment of the invention.

FIG. 1 shows a waste chamber 12 having an inlet 11 and an outlet 13. The inlet 11 is separated from the chamber 12 by a first valve V11. The outlet 13 is separated from the chamber 12 by a second valve V12. A pressure line 14 is coupled to the waste chamber 12 by a third valve V13. The arrows A11, A12 and A13 illustrate how fluid may flow through the device. A first arrow A11 illustrates waste flowing into the waste chamber 12 through the first valve V11. A second arrow A13 illustrates waste flowing out of the waste chamber 12 through the second valve A12. A third valve illustrates fluid flowing from the pressure line 14, through the third valve V13 and into the waste chamber 12.

In use, waste enters the waste chamber inlet 11 under force, such as gravity. The first valve V11 is open to allow the flow A11 into the waste chamber. The waste chamber outlet 13 is closed and waste accumulates in the chamber 12. The first valve V11 is closed and the third valve V13 is opened while the second valve V12 remains closed. Fluid enters the waste chamber 12 from the pressure line 14 under force. The force of the fluid may be mechanically generated by a pump, or result from gravitational potential energy. The fluid may be a gas, such as air. The pressure in the waste chamber is 12 increased. Subsequently, the second valve V12 is opened and the waste contained within the waste chamber 12 is expelled from the outlet 13 of the chamber. The second and third valves are closed and the first valve is opened to allow the cycle to begin again.

Figure 2:
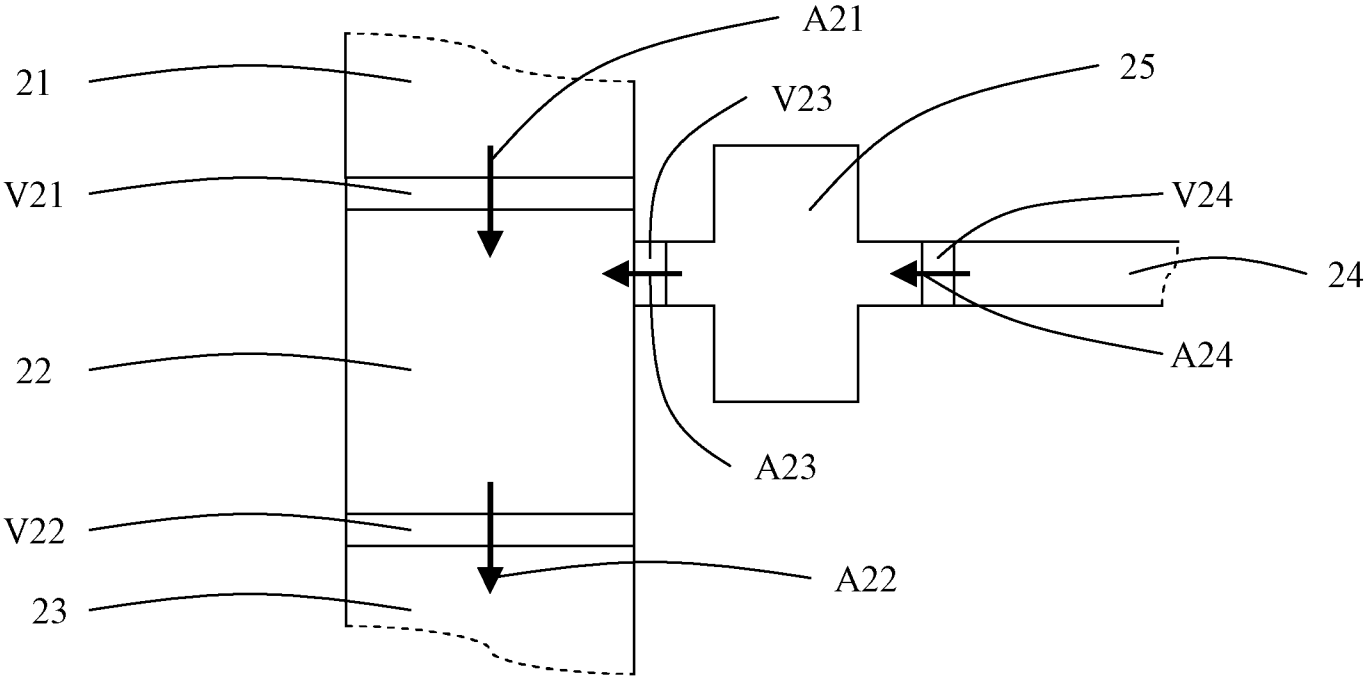
FIG. 2 is a schematic view of a second embodiment of the invention.

FIG. 2 shows a waste chamber 22 having an inlet 21 and an outlet 23. First V21, second V22 and third V23 valves are present (as in FIG. 1), as is a pressure line 24. In this embodiment, the device has a pressure chamber 25 coupled between the waste chamber 22 and the pressure line 24. The pressure chamber 25 is separated from the waste chamber and the pressure line by a third valve V23 and a fourth valve V24, respectively. Fluid may flow through the third V23 and fourth V24 valves as illustrated by the corresponding arrows A23, A24 when the corresponding valves are open. The volume of the pressure chamber 25 provides a pressure storage device.

In use, waste enters the waste chamber 22 as described in relation to FIG. 1 and illustrated by a first arrow A21. During this time, a fourth valve V24 opens permitting the flow A24 of fluid into the pressure chamber 25. A third valve V23 is closed preventing fluid from flowing into the waste chamber 22 from the pressure chamber. The waste chamber outlet 23 is obscured by a closed second valve V22, thus waste accumulates in the waste chamber. When the waste in the waste chamber reaches a predetermined level, or after a predetermined amount of time, a first valve V21 closes and waste is prevented from flowing into the waste chamber via the inlet 21. The fourth valve V24 is closed and the third valve V23 is opened allowing the pressurised fluid within the pressure chamber 25 to flow into the waste chamber 22 increasing the pressure within the waste chamber. The second valve V22 is opened and waste within the waste chamber is forced from the chamber via the outlet 23 by the pressurised fluid.

Figure 3:
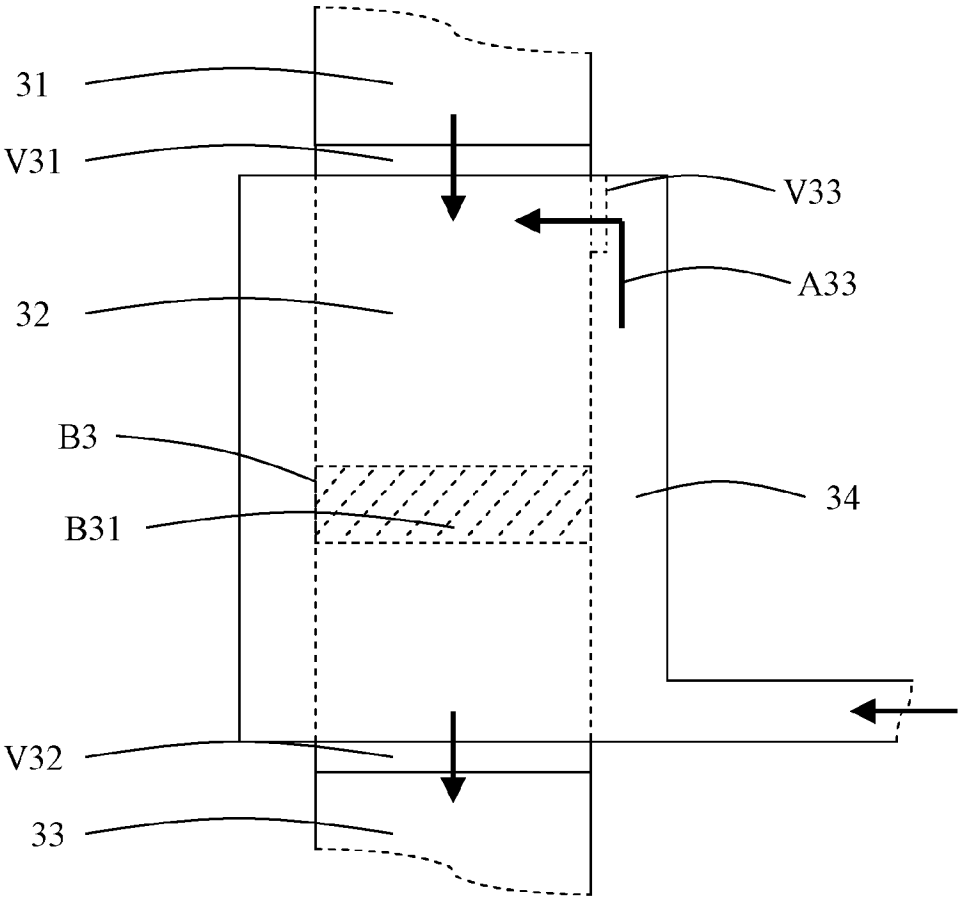
FIG. 3 is a schematic view of a third embodiment of the invention.

FIG. 3 shows a waste chamber 32 having an inlet 31 and an outlet 33 enabling the flow of waste through the chamber. If a first valve V31 at the inlet 31 is open and a second valve V32 at the outlet 33 is closed, waste will collect within the waste chamber. Within the chamber is a macerating device B3 comprising a plurality of blades B31. The macerator is for liquefying any solid waste contained in the waste chamber 31, whereby after maceration the waste will be a slurry. A pressure line 34 feeds into the waste chamber via a third valve V33. The pressure line 34 feeds pressurised fluid into the waste chamber 32 allowing the pressurised forced expulsion of waste from the waste chamber outlet 33 via the open second valve V32.

Figure 4:
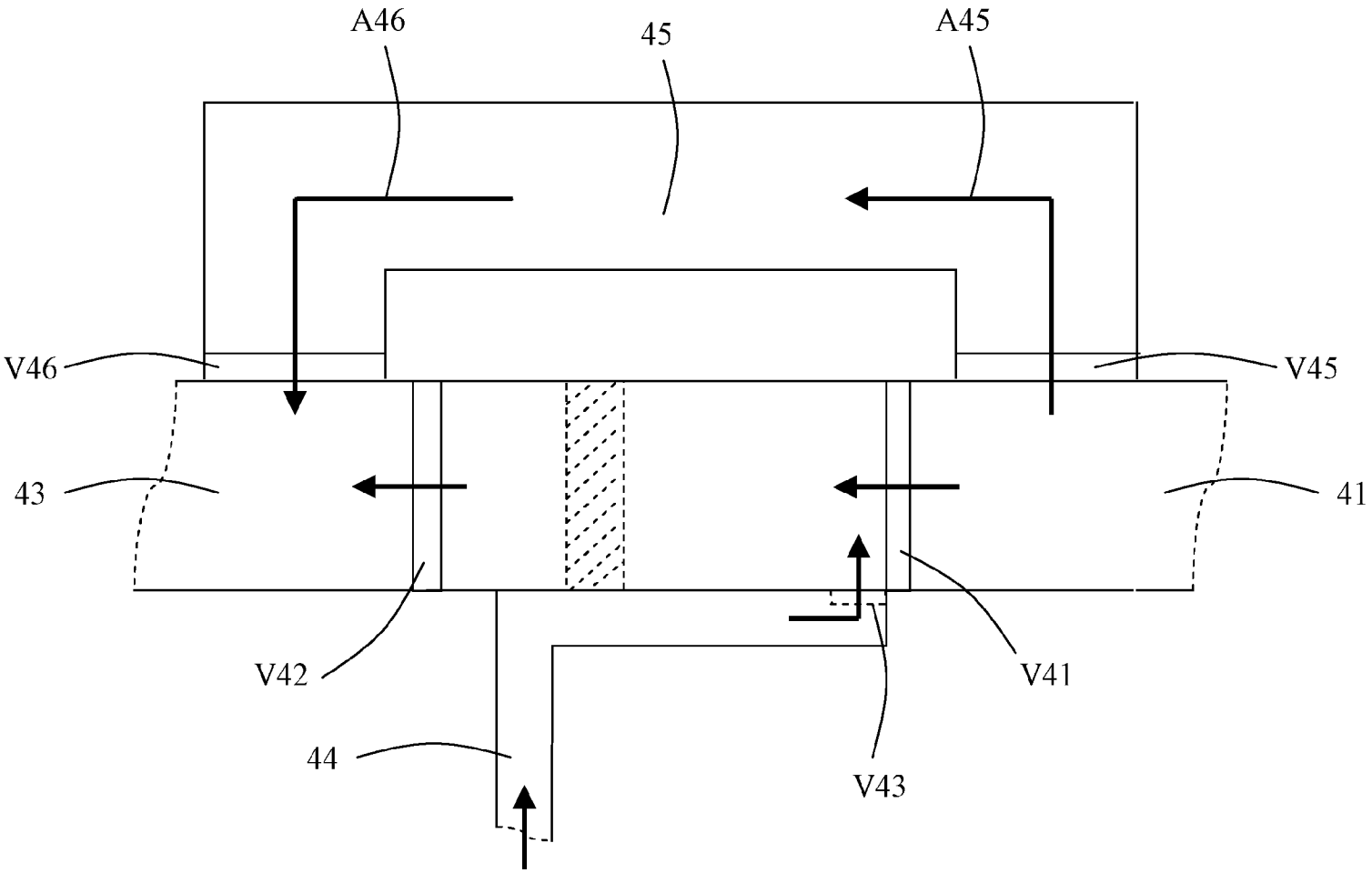
FIG. 4 is a schematic view of a fourth embodiment of the invention.

FIG. 4 shows a waste chamber with an inlet 41 separated from the chamber by a first valve V41 and an outlet 43 separated from the chamber by a second valve V42. The waste chamber is coupled to a pressure line 44 by a third valve V43. The waste chamber is operable to store and eject under pressure waste as is described above in relation to previous figures. The flow of waste from the inlet 41 to the outlet 43 is either through the waste chamber or through an overflow chamber 45. The overflow chamber is coupled to the inlet 41 by an overflow inlet valve V45 and to the outlet 43 by an overflow outlet valve V46. If the waste chamber inlet valve V41 is closed and the overflow inlet V45 and outlet V46 valves are open, waste may flow around the waste chamber bypassing the waste chamber, first valve and second valve. In some embodiments, the overflow mechanism is only used to expel liquid waste.

Figure 6:
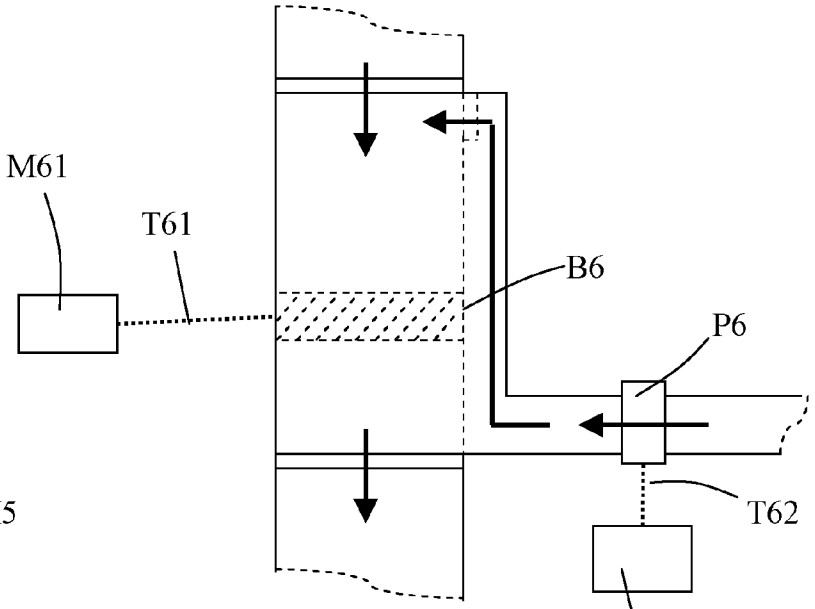
FIG. 6 is a schematic view of a sixth embodiment of the invention.
Figure 5:
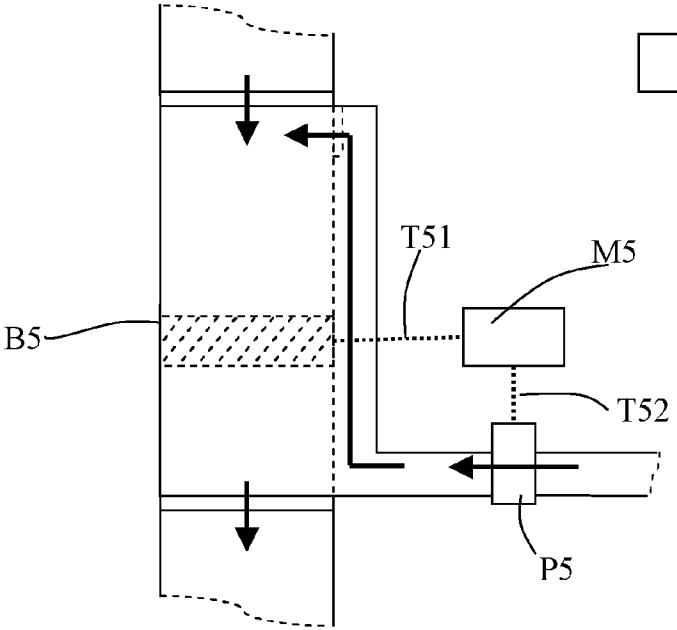
FIG. 5 is a schematic view of a fifth embodiment of the invention.

FIGS. 5 and 6 illustrate pumping devices. Both figures show waste chambers with inlets and outlets, both separated from waste chambers by valves. Both figures also show a macerator B5, B6 contained within a waste chamber coupled to a motor M5, M6.1 by a first transmission T5.1, T6.1. The figures show a pump P5, P6 coupled to a pressure line leading into the waste chamber. The pumps P5, P6 are both coupled to a motor M5, M6.2 by a second transmission T5.2, T6.2. In FIG. 5 a single motor M5 powers the macerator B5 and the pump P5, while in FIG. 6 the macerator M6 and the pump P6 are powered by two separate motors.

Figure 7:
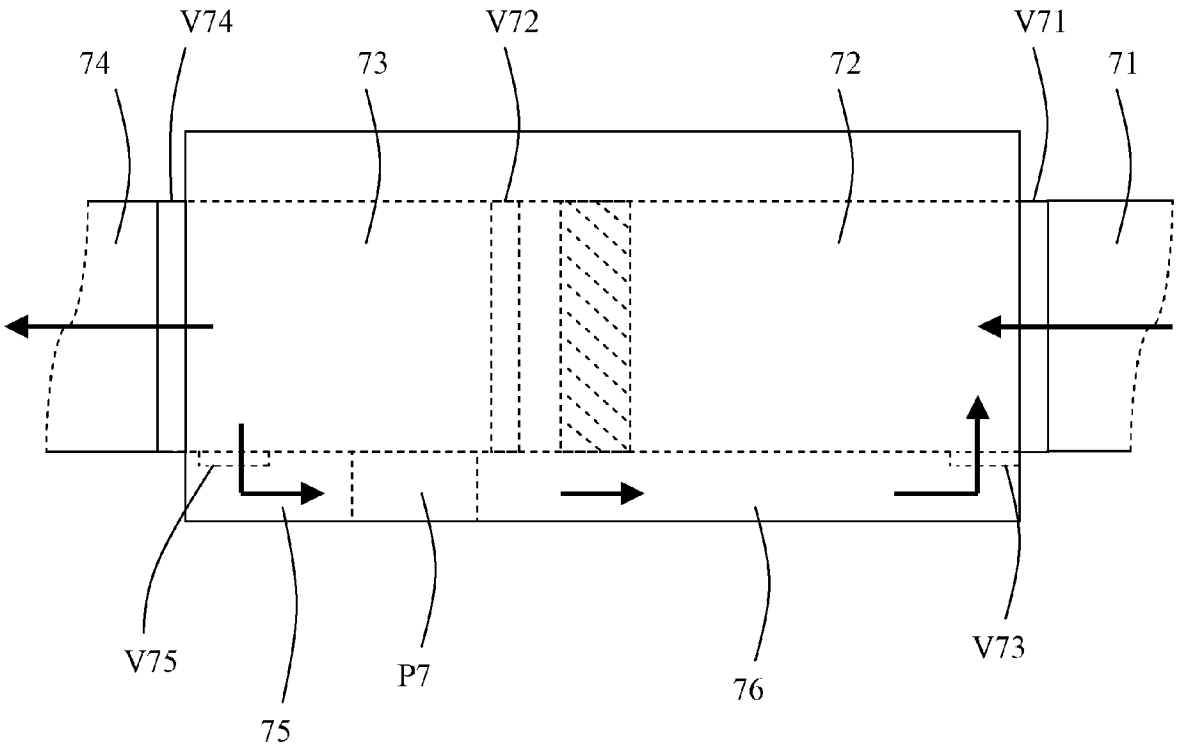
FIG. 7 is a schematic view of a seventh embodiment of the invention.

FIG. 7 shows a pumping device having an inlet 71 and an outlet 74. The inlet 71 is coupled to a first valve V71 and the outlet is coupled to a second valve V74. A waste chamber 72 is coupled to the inlet 71 by the first valve V71, whereby the waste chamber can selectively receive waste from the inlet. A vacuum chamber 73 is coupled to the waste chamber by a mid-valve V72, whereby the vacuum chamber can selectively receive waste from the waste chamber. The vacuum chamber 73 is coupled to the outlet 74 by the second valve V74. A macerator is installed within the waste chamber.

The vacuum chamber 73 is also coupled to a vacuum line 75 by a vacuum-valve V75. The vacuum line is coupled to a pump P7 for pumping fluid from the vacuum chamber 73 through the vacuum-valve V75, vacuum line 75 and the pump P7. The pump is coupled to a pressure line 76 and to the waste chamber 72 by a pressure-valve V73. Fluid flowing from the pump may pass through the pressure line and selectively through the pressure-valve into the pressure chamber.

In use, the first valve V71 opens to allow waste to flow into the waste chamber 72, and the mid-valve V72 is closed to prevent waste flowing from the chamber. Waste collects in the waste chamber and is reduced to a slurry, if required, by a macerator contained within the chamber. When the waste is to be evacuated from the device, the pump P7 is used to simultaneously reduce the pressure within the vacuum chamber 73 and increase the pressure within the waste chamber 72 by pumping fluid from the vacuum chamber to the waste chamber. To eject the waste, the mid-valve is opened and the pressure difference between the two chambers provides a force to accelerate matter from the waste chamber towards the outlet 74 which lies beyond the closed second valve V74. The second valve is opened and the waste continues to move towards the outlet through the open second valve. The second valve is closed after waste has passed through said valve.

Figure 9:
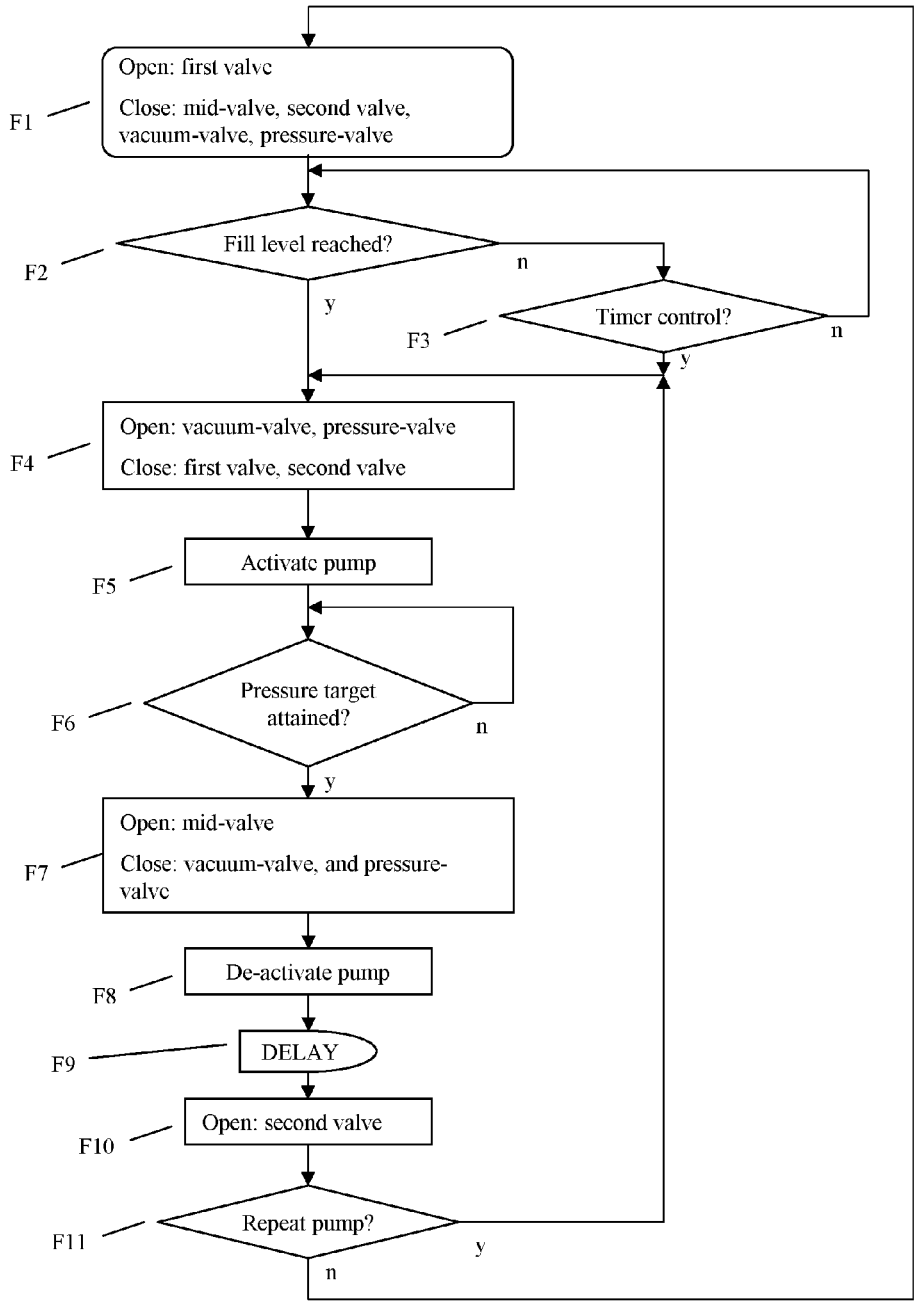
FIG. 9 is a flow chart for the operation of the seventh embodiment of the invention.

FIG. 9 shows a flow chart for the device illustrated in FIG. 7. The system is initiated F1 and sets the valves of the device to receive and store waste. The waste accumulates in the device waste chamber until the amount of waste fills the waste chamber to a predetermined level F2. A timer control F3 may be activated whereby the device will accumulate waste for either a predetermined amount of time, or until a predetermined time of day, thus not requiring the waste chamber to fill to the predetermined level. If the fill level F2 is reached or the timer control F3 value is achieved, the states of the valves of the device are changed F4 to stop waste entering the waste chamber—the waste chamber and the vacuum chamber are sealed except for openings leading to a pump. The pump is activated F5 to pump fluid from the sealed vacuum chamber into the sealed pressure chamber, thereby increasing the relative pressure within the waste chamber and decreasing the relative pressure within the vacuum chamber. A pressure sensor present in the waste chamber, the vacuum chamber, and/or a chamber within which the pump is housed is monitored and when a predetermined pressure is reached, the valve statuses change F7, whereby the vacuum and pressure-valves close—isolating the pump and stopping the movement of air between the waste chamber and the vacuum chamber through the pump—and the mid-valve opens. The pump is deactivated F8. Waste in the waste chamber is no longer contained in the chamber as the fluid in the waste chamber expands and pushes the waste into the vacuum chamber where the relative pressure is lower.

During a delay F9, the waste is accelerated towards and into the vacuum chamber and continues towards the second valve. The second valve opens F10 and the waste continues its vector towards and through the second valve. The pumping of the device may be repeated a number of times, which is represented by decision function F11. Should a repeat pumping be required, the system again sets the valves F4 in preparation for pumping, otherwise the system sets the valves so that more waste may be received in the waste chamber F1.

Figure 8:
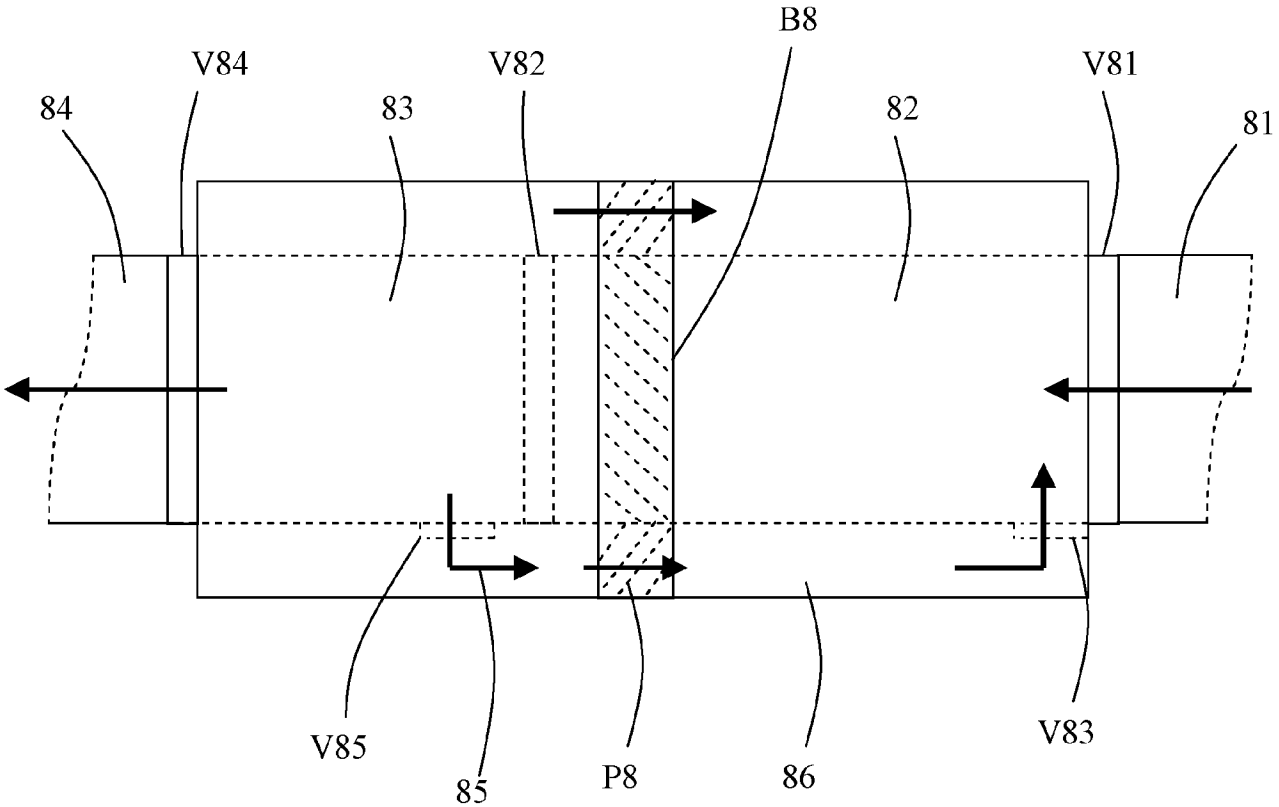
FIG. 8 is a schematic view of a eighth embodiment of the invention.

FIG. 8 shows a pumping device similar to that shown in FIG. 7. In FIG. 8 the vacuum chamber 83 is coupled to a vacuum line 85 by a vacuum-valve V85. The vacuum line is further coupled to a pump P8 for pumping fluid from the vacuum chamber 83 through the vacuum-valve V85, vacuum line 85 and pump P8. The pump is coupled through a pressure line 86 and a pressure-valve V83 to the waste chamber 82, whereby fluid flowing from the pump may pass through the pressure line and selectively through the pressure-valve into the pressure chamber. The macerator B8 and pump P8 are concentric, coupled together and have a corresponding rotating motion. The macerator and pump may be formed from a single piece of material, or by joining together multiple pieces of material. As the pump P8 is disposed around the waste compartment 82, the pumping effect is also around the waste compartment as can be seen in FIG. 8 where fluid is being pumped both above and below the cross-section as is illustrated by the two arrows both going from left to right and indicating movement of pumped fluid.

In another embodiment (not shown), the macerator and pump are coupled by a concentric gearing system.

In the embodiment described in relation to FIG. 9, a level sensor, timer, and/or pressure sensor may not be required. A timer may ensure that the waste container is emptied regularly, thus the level sensor may not be required. The waste compartment may be emptied only when it is a certain percentage full, thus the timer may not be required. The pump may be activated for a set period of time, thus the pressure sensor may not be required.

Figure 10:
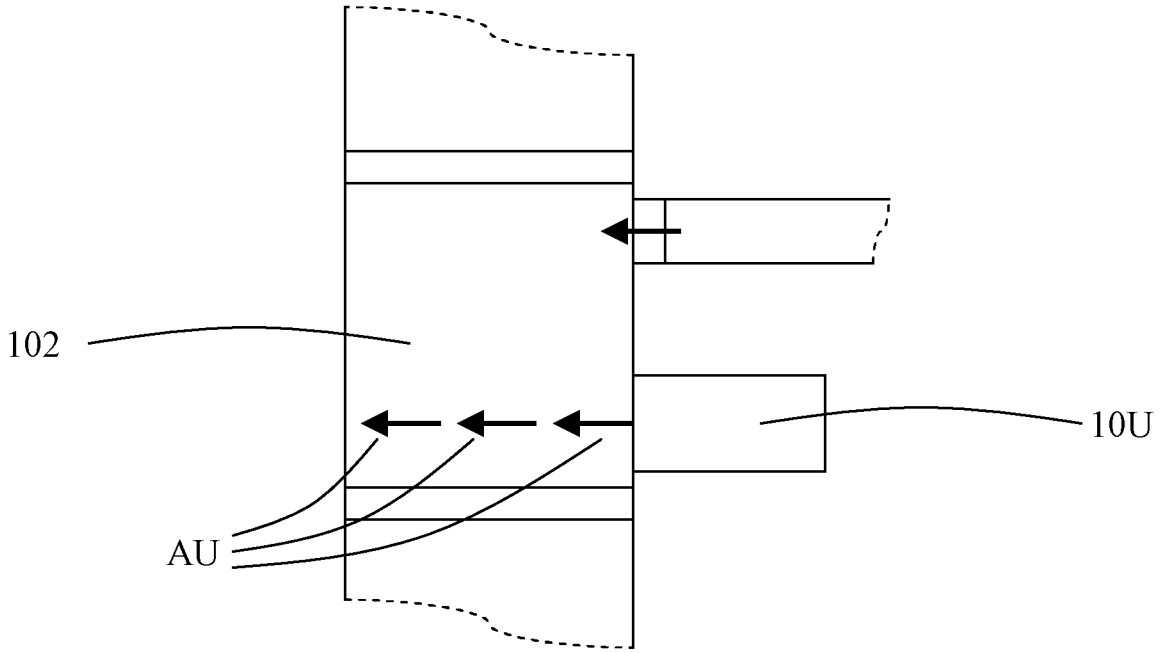
FIG. 10 is a schematic view of a ninth embodiment of the invention.

FIG. 10 shows a pumping device having a waste chamber 102 for storing waste, and an ultrasonic macerator 10U for macerating waste stored in the waste container. The ultrasonic macerator emits ultrasonic pressure waves AU into the waste to disintegrate the waste. The ultrasonic macerator may be used instead of a mechanical macerator or in conjunction with a mechanical macerator.

Various modifications will be apparent to those skilled in the art. For example, a macerator may or may not be present in any of the above-described embodiments. A macerator will not be required if the waste that the pumping device acts on does not contain solids. The level sensor described in relation to FIG. 9 may be present in any embodiment. The timer activation described in relation to FIG. 9 may be present in any embodiment. The pressure applied to the waste chamber, or pressure chamber, may be varied. The pressure may be dependent upon the type of waste being disposed, and/or the amount of waste being disposed. The type of waste may dictate whether or not a macerator is needed. Optionally, if the pressure applied to the waste is very high, this can cause a macerating effect when the waste is ejected from the waste chamber and the use of a macerator may be avoided. If the amount of waste in the waste chamber is below a predetermined level, maceration may be avoided by pressurising the waste chamber a predetermined pressure level. Different pressure levels may have different corresponding pressurisations where maceration is not required.

The fluid pumped into the waste chamber to increase the pressure in the chamber will usually be air, however, this invention should not be limited to this particular fluid as any compressible fluid may be used.

A waste chamber waste level sensor is not illustrated in the figures. The waste level sensor may be implemented by an ultrasound emitter and receiver, wherein the level of the waste affects the time taken for emitted ultrasound to reflect off the waste surface and be detected by the receiver. Alternatively, the level sensor may be implemented by a mechanical float within the chamber connecting to a mechanical switch; or a pneumatic sensor whereby the weight of the waste displaces a membrane in the waste chamber and the displacement is measured.

What is claimed is:

1. A pumping device for pumping waste, comprising
- a waste chamber, for storing waste, having an inlet for receiving waste and an outlet for transmitting waste;
- a first valve for controlling received waste from the waste chamber inlet;
- a second valve for controlling transmitted waste through the waste chamber outlet;
- a pump; and
- a pressure chamber, connected between the pump and the waste chamber, for storing pressure generated by the pump;
- wherein the pump is operable to increase pressure within the pressure chamber;
- wherein the pressure chamber is arranged to selectively release stored pressure into the waste chamber when the first and second valve are closed; and
- wherein the waste is forced from the waste chamber through the second valve by the pressure within the waste chamber when the second valve is opened.

2. The pumping device according to claim 1, further comprising a macerator in the waste chamber.

3. The pumping device according to claim 2, wherein the pump and the macerator are powered by a single motor.

4. The pumping device according to claim 2, wherein the pump and the macerator intercommunicate.

5. The pumping device according to claim 1, further comprising a bypass conduit to enable a flow of waste around the waste chamber when the first and second valves are closed.

6. The pumping device according to claim 5, wherein the bypass conduit has an entry valve for controlling the flow of waste into the bypass conduit, and an exit valve for controlling the flow of waste out of the bypass conduit.

7. The pumping device according to claim 1, further comprising a waste level sensor in the waste chamber, wherein
- the waste is forced from the waste chamber when the waste level in the waste chamber exceeds a predetermined value.

8. The pumping device according to claim 1, further comprising a clock, wherein
- the operation of the waste chamber is dependent upon the time of day as provided by the clock.

9. The pumping device according to claim 1, further comprising a vacuum chamber coupled to the waste chamber output, the vacuum chamber having an inlet and an outlet.

10. The pumping device according to claim 9, wherein the pump is operable to reduce the pressure in the vacuum chamber.

11. The pumping device according to claim 9, further comprising a valve at the vacuum chamber output, wherein the device is operable to open the pressure chamber output and the vacuum chamber output when the pressure in the pressure chamber is greater than the pressure in the vacuum chamber.

12. The pumping device according to claim 11, wherein the pressure chamber output is opened prior to the opening of the vacuum chamber output.

13. A method of pumping waste comprising the steps:

(i) opening a first valve to enable waste to flow into a waste chamber and closing a second valve to stop waste flowing out of the waste chamber;

(ii) closing the first valve to stop waste flowing into the waste chamber;

(iii) selectively releasing pressure from a pressure chamber connected between a pump and the waste chamber to increase the pressure within the waste chamber to be greater than the pressure outside the waste chamber; and (iv) opening the second valve to enable waste to flow out of the waste chamber.

14. The method of claim 13, wherein the pump first increases the pressure within a pressure chamber before opening the pressure chamber to the waste chamber.

15. The method of claim 13, further comprising the step of using a macerator to macerate the waste within the waste chamber.

16. The method of claim 13, further comprising the steps of decreasing the pressure within a vacuum chamber coupled to, but closed from, the waste chamber; and opening the waste chamber to the vacuum chamber.

17. The method of claim 16, wherein the pump pumps a fluid from the vacuum chamber into the waste chamber to alter the pressure of the vacuum and waste chambers.

18. The method of claim 13, wherein the first valve is not closed until the amount of waste in the waste chamber as detected by a waste level sensor is above a predetermined threshold.

19. The method of claim 13, wherein the closing the first valve is dependent upon the time of day as provided by a clock.

* * * * *